US006667716B2

(12) United States Patent
Chen

(10) Patent No.: US 6,667,716 B2
(45) Date of Patent: Dec. 23, 2003

(54) PLANAR INVERTED F-TYPE ANTENNA

(75) Inventor: Tailee Chen, Taipei (TW)

(73) Assignee: GemTek Technology Co., Ltd., Hsinchu (TW)

( * ) Notice: Subject to any disclaimer, the term of this patent is extended or adjusted under 35 U.S.C. 154(b) by 0 days.

(21) Appl. No.: 09/987,069

(22) Filed: Nov. 13, 2001

(65) Prior Publication Data

US 2003/0038749 A1 Feb. 27, 2003

(30) Foreign Application Priority Data

Aug. 24, 2001 (TW) ..... 90120959 A

(51) Int. Cl.[7] ..... H01Q 1/38
(52) U.S. Cl. ..... 343/700 MS; 343/846
(58) Field of Search ..... 343/700 MS, 702, 343/846, 848, 860

(56) References Cited

U.S. PATENT DOCUMENTS 4,326,203 A * 4/1982 Kaloi ..... 343/700 MS
4,700,194 A * 10/1987 Ogawa et al. ..... 343/700 MS
5,355,142 A * 10/1994 Marshall et al. ..... 343/700 MS
5,784,034 A * 7/1998 Konishi et al. ..... 343/895
6,184,833 B1 * 2/2001 Tran ..... 343/700 MS
6,218,991 B1 * 4/2001 Sanad ..... 343/700 MS
6,326,919 B1 * 12/2001 Diximus et al. ..... 343/700 MS
6,339,402 B1 * 1/2002 McKivergan ..... 343/700 MS
6,348,892 B1 * 2/2002 Annamaa et al. .... 343/700 MS

* cited by examiner

*Primary Examiner*—Tan Ho
(74) *Attorney, Agent, or Firm*—Troxell Law Office PLLC

(57) ABSTRACT

An improved planar inverted F-type antenna comprises a metal ground plane having a feeding metal bore formed thereon, and a flat metal plate in parallel with the metal ground plane. The flat metal plate further includes an open circuit end and a short circuit end and provides a feeding leg to pass through the feeding metal bore. The short circuit end connects the metal ground plane through a short circuit leg. The distance between the open circuit end and short circuit end of the flat metal plate is proximate a quarter of wavelengths. The flat metal plate is formed as an open-short circuit trapezoid-shaped structure. The trapezoid-shaped structure increases operative bandwidth of the antenna.

6 Claims, 3 Drawing Sheets

PLANAR INVERTED F-TYPE ANTENNA

FIELD OF THE INVENTION

The present invention relates to a planar inverted F-type antenna and more particularly to an improved planar inverted F-type antenna for increasing operative bandwidth and enhancing signal quality.

BACKGROUND OF THE INVENTION

The rapid innovation and development of wireless communication technology have created a wide range of communication products in recent years. Among them, mobile communication products that integrate 3C technologies and communication modules are the mainstream of the market these days. These products include notebook computers, PDA, Palm, etc. They can couple with communication modules to link LAN (Local Area Network), to transmit and receive e-mail, and to receive instant information (such as news, stocks quotations and so on) for sharing resources and information. The planar inverted F-type antennas are known to have the advantages of compact size and light weight, thus have been widely adopted as built-in antennas in the mobile communication products.

Referring to FIG. 1 for a conventional planar inverted F-type antenna, the antenna includes a metal ground plane 10, a flat metal plate 12, a short circuit leg 14 and a feeding leg 16. The metal ground plane 10 is substantially parallel with the flat metal plate 12 and has a feeding metal bore 15. The short circuit leg 14 and the feeding leg 16 are located respectively on one side of the flat metal plate 12. The short circuit leg 14 connects the metal ground plane 10. The feeding leg 16 passes through the feeding metal bore 15 to connect a matching circuit (not shown in the drawing) for generating matching impedance. The flat metal plate 12 is a rectangular thin metal sheet having one side connected with the short circuit leg 14 to form a short circuit end and another side formed an open circuit end. The distance between the short circuit end and the open circuit end is preferably a quarter of wavelengths.

As the current on the flat metal plate 12 adopting conventional techniques has a constant length, the transmitting and receiving signals through the antenna also have constant frequency. As a result, the operative bandwidth is limited, and thus applications of the antenna are restricted.

Moreover, the feeding leg 16 adopting conventional technique is located at one side of the flat metal plate 12. Because the antenna is not a symmetrical structure, hence it cannot generate symmetrical radiation field in the horizontal direction. As a result, signal transmission and receiving quality of the antenna is definitely not satisfactory.

Therefore, producers of the planar inverted F-type antenna have devoted a lot of research and development efforts to improve the operating bandwidth and enhance the transmission quality.

SUMMARY OF THE INVENTION

The primary object of the invention is to provide an improved planar inverted F-type antenna for increasing operating bandwidth of the antenna.

Another object of the invention is to provide an improved planar inverted F-type antenna for enhancing signal quality of the antenna while transmitting and receiving data.

A further object of the invention is to provide an improved planar inverted F-type antenna design that is simpler to fabricate and is adaptable for mass production.

The improved planar inverted F-type antenna of the invention has a feeding leg of the antenna soldered to a center location of a flat metal plate that has two symmetrical sides thereof. A supplying current is fed at the center such that left and right symmetrical radiation fields can be generated from the antenna structure plate. As a result, signal quality for data transmitting and receiving of the present invention is better than that of an antenna adopting the conventional techniques. Moreover, the invention offers various shapes of the flat metal plate to change the feeding current route distance so as to increase operative bandwidth. In addition, the invention provides a novel fabrication method to make the feeding leg and forms an inverted U-shaped slit structure at a selected location in the center of the flat metal plate. The middle portion of the metal slit structure is bent downwards to form a feeding leg for passing through the feeding metal bore to replace soldering for making the feeding leg. The antenna thus can be integrally made of a single metal element and may be adaptable for mass production.

The foregoing, as well as additional objects, features and advantages of the invention will be more readily apparent from the following detailed description, which proceeds with reference to the accompanying drawings.

DESCRIPTION OF THE PREFERRED EMBODIMENTS

The invention aims at providing an improved planar inverted F-type antenna that has a more symmetrical radiation field to improve transmitting and receiving signal quality, has a wider operative bandwidth for receiving and transmitting more signals of different frequencies, and is integrally made to streamline fabrication process for mass production. Details of the invention will be elaborated as follows.

Figure 1:
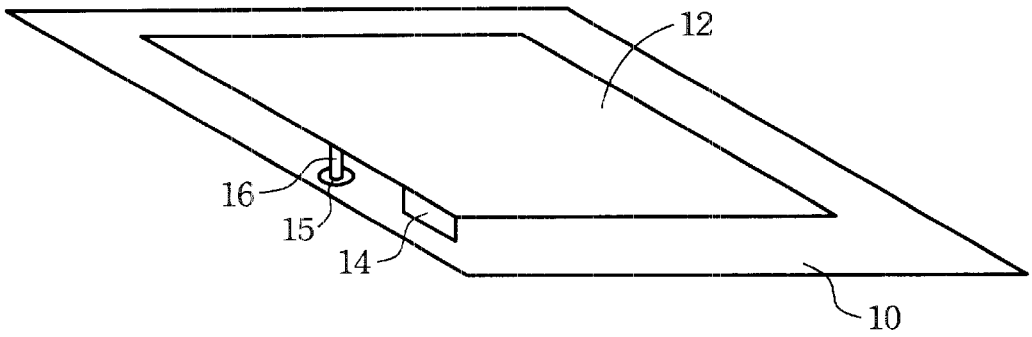
FIG. 1 (PRIOR ART)
FIG. 1 is a schematic perspective view of a conventional planar inverted-F type antenna.
Figure 2A:
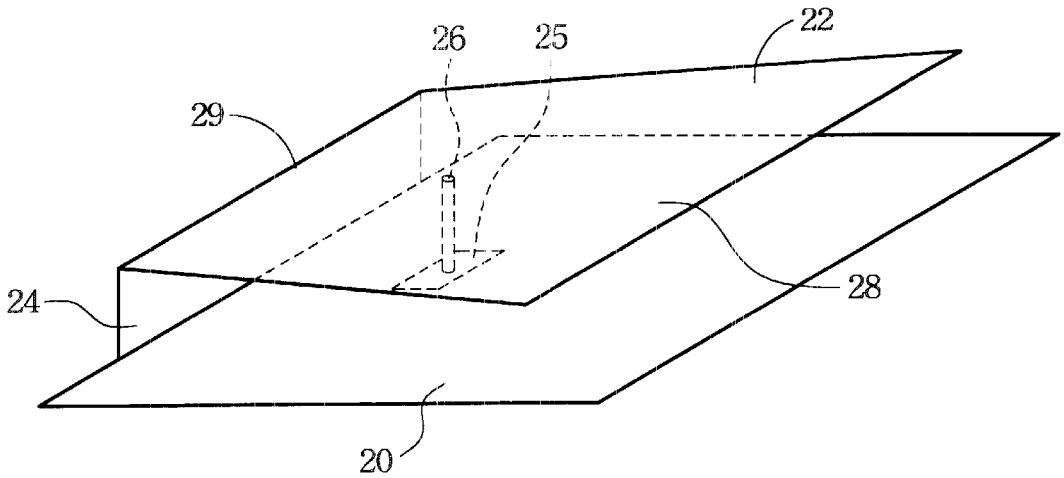
FIG. 2A is a schematic view of a first embodiment of the invention

Referring to FIG. 2A for a first embodiment of the invention, the antenna consists of a metal ground plane 20, a trapezoid flat metal plate 22 in parallel with the metal ground plane 20, a grounded short circuit leg 24, a feeding leg 26, and a metal bore 25 formed on the metal ground plane 20. The trapezoid flat metal plate 22 has an open circuit end 28 and a short circuit end 29 that connects the metal ground plane 20 through the short circuit leg 24. The feeding leg 26 is soldered to the trapezoid flat metal plate 22. The feeding leg 26 passes through the metal bore 25 of the metal ground plane 20 for connecting with a matching circuit under the metal ground plane 20 (not shown in the drawing) for generating matching impedance, but does not contact with the metal ground plane 20.

The flat metal plate 22 has a length about a quarter of wavelengths to form an open-circuit and short-circuit structure. The trapezoid-shaped structure can change the feeding current route to allow the antenna to receive signals of different frequencies thereby to increase the operative bandwidth of the antenna.

In the embodiment, the feeding leg 26 is located under the center of the trapezoid flat metal plate 22 and is symmetrical to both sides of the trapezoid flat metal plate 22 so that, a left and right symmetrical radiation field will be generated. As a result, signal quality for data transmitting or receiving will be improved over those that adopt conventional techniques.

In the first embodiment set forth above, the side width of the trapezoid flat metal plate 22 is gradually tapered off from the open circuit end 28 to the short circuit end 29.

Figure 2B:
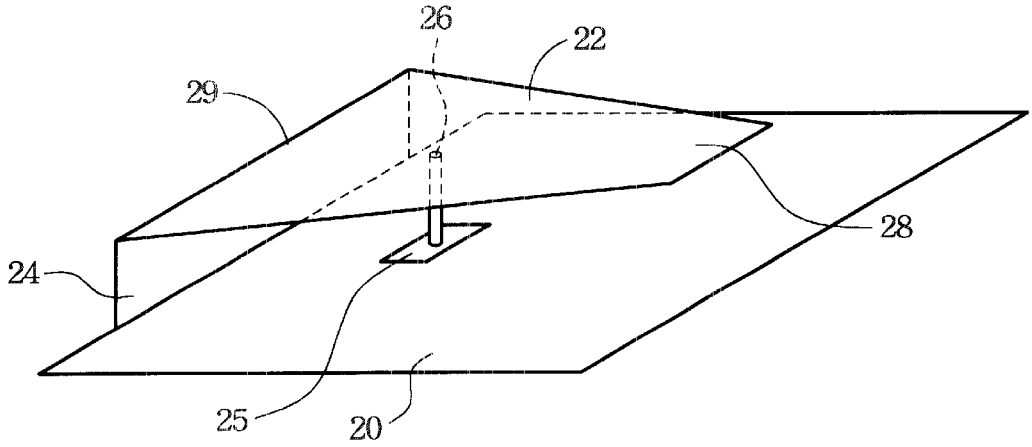
FIG. 2B is a schematic view of a second embodiment of the invention.

FIG. 2B shows a second embodiment of the invention that is substantially similar to the first embodiment previously discussed except that the side width of the trapezoid flat metal plate 22 is gradually tapered off from the short circuit end 29 to the open circuit end 28.

Figure 3:
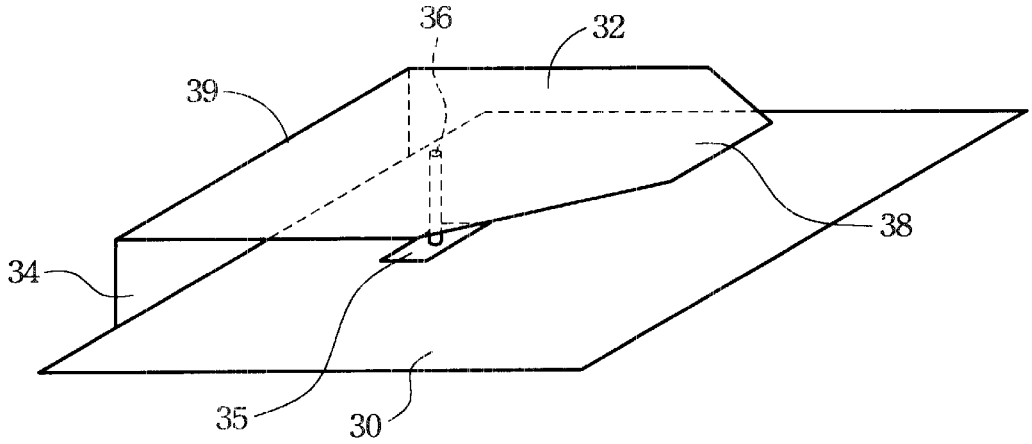
FIG. 3 is a schematic view of a third embodiment of the invention.

FIG. 3 shows a third embodiment of the invention which consists of a metal ground plane 30, a flat metal plate 32 in parallel with the metal ground plane 30, a grounded short circuit leg 34, a feeding leg 36, and a metal bore 35 formed on the ground metal plane 30. The flat metal plate 32 has an open circuit end 38 and a short circuit end 39 that connects the metal ground plane 30 through the short circuit leg 34. The open circuit end 38 has at least one chamfered corner (preferably two chamfered corners). The feeding leg 36 is soldered to the flat metal plate 32. The feeding leg 36 passes through the feeding metal bore 35 of the metal ground plane 30 to connect a matching circuit under the metal ground plane 30 (not shown in the drawing) for generating matching impedance, but does not contact with the metal ground plane 30.

The flat metal plate 32 has a length about a quarter of wavelengths from the open circuit end 38 to the short circuit end 39, in which the open circuit end 38 includes two chamfered corners for increasing the operative bandwidth of the antenna. Because of the chamfer corners formed at the open circuit end 38, the lengths of the current route will be different, thus the antenna can receive signals of different frequencies so as to increase the operative bandwidth of the antenna.

In the embodiment, the feeding leg 36 is located under the center of the flat metal plate 32 and is symmetrical to two sides of the flat metal plate 32, so that, a left and right symmetrical radiation field will be generated. As a result, signal quality for data transmitting or receiving will be improved over those that adopt conventional techniques.

Figure 4:
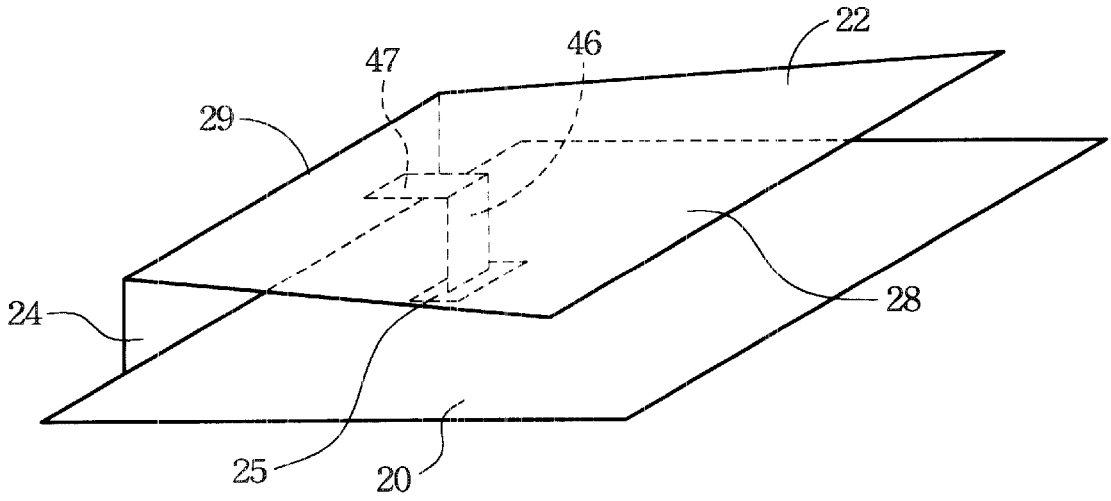
FIG. 4 is a schematic view of a fourth embodiment of the invention.

FIG. 4 shows a fourth embodiment of the invention that is largely similar to the first embodiment of FIG. 2A previously discussed. In both embodiments, similar elements are marked by the same numerals. Different features and function will be discussed below while similar structure and function will be omitted. The trapezoid flat metal plate 22 corresponding to the feeding metal bore 25 is attached to an inverted U-shaped slit structure 47 which has a middle metal section bent downwards ninety degrees to form a feeding leg 46 passing through the feeding metal bore 25 and forming on the flat metal plate 22 a slit 47 with an area matching the feeding leg 46.

The feeding leg 46 can be integrally formed. Hence, it can save both soldering time and costs, and is adaptable for mass production.

Figure 5:
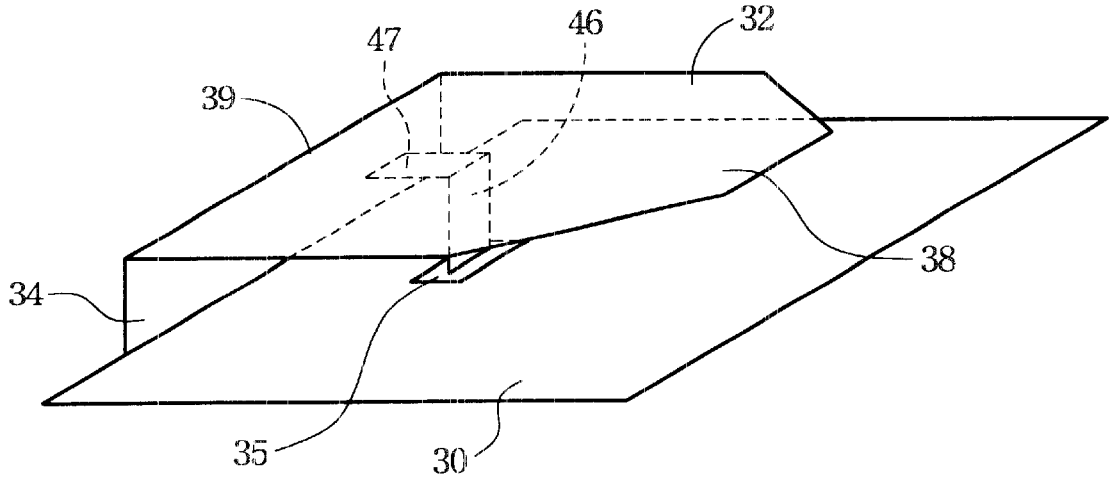
FIG. 5 is a schematic view of a fifth embodiment of the invention.

FIG. 5 shows a fifth embodiment of the invention that is substantially an alternation of the third embodiment of FIG. 3 previously discussed. In both embodiments, similar elements are marked by the same numerals. Except for inverted U-shaped slit structure 47, detailed structure and function of this embodiment are the same as those of the third embodiment and thus will be omitted herein. Apparently from FIG. 4, the feeding current leg 46 and the slit structure 47 used in the fourth embodiment are applied to this embodiment for saving soldering time and costs.

In summary, the invention provides the following advantages over the conventional techniques:

a. The feeding leg of the invention is located in the center below the flat metal plate and is symmetrical to two sides on the surface distance. When signals are fed, a left and right symmetrical radiation field will be generated. Thus this invention can achieve better signal quality for data transmitting or receiving than those that adopt the conventional techniques.

b. The trapezoid flat metal plate structure can generate different lengths of electric current routes for the current and allows the antenna to receive changed signal frequencies and thus to increase the antenna operative bandwidth.

c. The inverted U-shaped slit structure under the flat metal plate is bent ninety degrees to form the feeding leg. It can be integrally formed to save production time and costs and is adaptable for mass production.

While the preferred embodiment of the inventions have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An improved planar inverted F-type antenna, comprising:

a metal ground plane having a feeding metal bore formed thereon;

a flat metal plate in parallel with the metal ground plane, having thereof an open circuit end and a short circuit end, the short circuit end being connected to the metal ground plane through a short circuit leg, the flat metal plate further having a feeding leg passing through the feeding metal bore, wherein the flat metal plate has a length of a quarter of wavelengths and forms an open-short circuit flat plate structure; and a slit structure on the flat metal plate at a location corresponding to the feeding metal bore, the slit structure having a middle metal section bent to form the feeding leg passing through the feeding metal bore, the slit structure forming on the flat metal plate a slit with an area matching the feeding leg, whereby the flat metal plate with the slit structure can change the feeding current route thereby enabling the antenna to receive signals of different frequencies thereby to increase operative bandwidth of the antenna.

2. The improved planar inverted F-type antenna of claim 1, wherein the slit structure is an inverted U-shaped slit structure.

3. The improved planar inverted F-type antenna of claim 1, wherein the feeding leg passes through the feeding metal bore without contacting the metal round plane.

4. The improved planar inverted F-type antenna of claim 3, wherein the feeding is located in a middle of the flat metal plate and is symmetrical to two opposite sides of the flat metal plate thereby enabling the flat metal play to generate a horizontally symmetrical radiation field.

5. The improved planar inverted F-type antenna of claim 1, wherein the flat metal plate has a trapezoidal configuration with a long end and a short end, wherein the open circuit end is at the long end.

6. The improved planar inverted F-type antenna of claim 1, wherein the flat metal plate has a trapezoidal configuration with a long end and a short end, wherein the open circuit end is at the short end.

* * * * *